United States Patent [19]

Cattorini et al.

[11] 4,213,601

[45] Jul. 22, 1980

[54] PRINTER ELEVATOR CONTROL MECHANISM

[75] Inventors: Joseph F. Cattorini, Palm Bay; Thomas R. Park; John K. Martin, both of West Melbourne, all of Fla.

[73] Assignee: Documation Incorporated, Melbourne, Fla.

[21] Appl. No.: 958,014

[22] Filed: Nov. 6, 1978

[51] Int. Cl.[2] ..... B65H 45/00

[52] U.S. Cl. ..... 270/61 F

[58] Field of Search ..... 270/61 F, 73, 79; 414/84, 87, 88; 93/93 C; 271/215

[56] References Cited

U.S. PATENT DOCUMENTS

| | | | |
|---|---|---|---|
| 3,037,768 | 5/1962 | Anderson | 270/73 |
| 3,571,574 | 3/1971 | Gerber | 93/93 C |
| 4,030,720 | 6/1977 | Jones | 270/61 F |

*Primary Examiner*—Edgar S. Burr

*Assistant Examiner*—A. Heinz

*Attorney, Agent, or Firm*—Duckworth, Hobby, Allen & Pettis

[57] ABSTRACT

A high speed printer elevator control mechanism includes an elevator frame having a paper guide chute for guiding paper into a bin and rides up and down in the bin responsive to an electric motor drive. The elevator moves a pre-determined distance above the paper being stacked in the bin responsive to control signals initiated by counting the paper being stacked in the bin. A pair of paper control strips or flappers are mounted to the elevator frame for guiding the paper in the bin and a switch is mounted to the elevator frame adjacent one of the flappers so that the switch is actuated by the movement of the paper control strip to generate a signal by each movement thereof. The signals are counted by the microprocessor which initiates the command to move the elevator.

9 Claims, 4 Drawing Figures

PRINTER ELEVATOR CONTROL MECHANISM

BACKGROUND OF THE INVENTION

The present invention relates to high speed line printers, and especially to the paper stacker assembly for stacking paper in a bin in a high speed line printer.

In the impact printing field, a wide variety of printing techniques have been utilized in the past, including the present type of printer, which uses an endless steel character band having various characters of the alphabet as well as numbers embossed or raised upon the band. The band is rotated between a drive pulley and an idler pulley. As the band is driven at high speeds adjacent a platen, a bank of parallel hammers is driven at high speed at the moment that a particular desired character is passing on the band to print the characters on the paper. Inasmuch as a bank of print hammer actuators is fired electromagnetically as the band is passing at high speed, printing is accomplished at a very high speed so that the paper being printed upon is rapidly passing over the platen and being printed upon and fed into a stacker assembly, typically located in the rear of the printer, which must stack the paper evenly in folds. Controls are provided to indicate when the stacker bin is filled, as well as means to hold the paper compacted in the bin. In a stacker assembly of the present type, an elevator is mounted therein and rides on a shaft and is raised and lowered by an electric motor driving a cog belt or the like. The motor raises or lowers the elevator responsive to controls from the microprocessor of the high speed printer, which generates signals in accordance with the position of the elevator and the paper as the paper is fed into the bin.

In prior stacker assemblies, it has been known to compact the paper in the bin by the use of flexible belts mounted on either side of the paper bin having flexible flaps thereon which are rotated to compact the paper. It has also been known in the past to vary the speed of an elevator in accordance with the speed of the printing and the thickness of the paper so that the elevator continuously moves at a predetermined speed. Other techniques involve the use of photo cells for detecting the position of materials in bins. The present invention, on the other hand, utilizes simple mechanical sensors generating electrical pulses which operate an elevator in accordance with signals generated in a printer microprocessor.

SUMMARY OF THE INVENTION

The present invention relates to a high speed printer stacker assembly elevator control mechanism having an elevator frame adapted to be shifted responsive to the operation of the printer. A paper feed for feeding paper into a stack is attached to the elevator frame and guides paper therethrough into the stacking bin. A pair of paper control strips or flappers is mounted adjacent the paper feed for directing the paper into alternate folds in the stacking bin and a hall effect switch mounted adjacent one flapper is actuated by the flapper being hit by the stacking paper. The switch generates signals responsive to the movement of one paper control strip having one paper fold folding thereagainst. The switch is connected to the microprocessor as is a stacker full sensor which generates signals for driving the elevator drive motor upon predetermined signals being received by the microprocessor so that the printer elevator can be raised in accordance with the height of the stacked paper and also signal when the stacking bin is filled with paper.

BRIEF DESCRIPTION OF THE DRAWINGS

Other objects, features, and advantages of the present invention will be apparent from the written description and the drawings, in which.

DESCRIPTION OF THE PREFERRED EMBODIMENT

Figure 1:
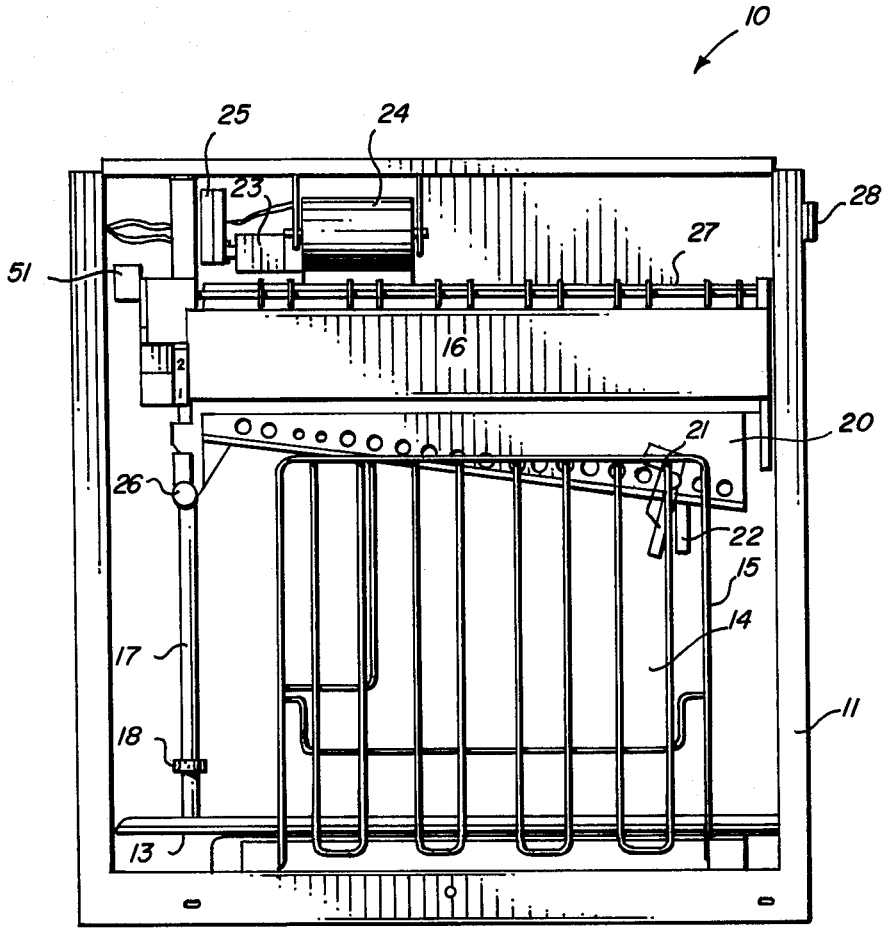
FIG. 1 is a side elevation of a stacker assembly in accordance with the present invention.

Referring now to FIG. 1, an overall view of a stacker assembly 10 is illustrated having a frame 11 with a floor 13 on the bottom of a stacking bin 14 and front and rear form guides 15 for guiding forms into the stack. The stacker assembly includes an elevator 16 mounted therein riding on a shaft 17 driven by a belt (not shown) having a collar 18 thereon. The elevator 16 has paper guide chutes 20, which have flapper or paper control strips 21 and 22 mounted on each side of the guide chute 20. The elevator assembly 16 rides up and down in the bin 14 on the shaft 17 responsive to a cog belt (not shown) driven by an elevator drive motor 23 having a negator 24 mounted adjacent thereto. The elevator drive motor 23 drives a gearing assembly 25 which actuates the cog belt in a forward or a reverse direction according to the direction of the rotation of the drive motor 23 to raise or lower the elevator 16. An elevator adjustment arm lever 26 is provided for making adjustments to the elevator. A paper drive system 27 is mounted to drive paper through the paper chute guides 20 (FIG. 2) into the stacking bin 14. An electrical connector 28 is seen for electrical connections to the stacker assembly.

Figure 2:
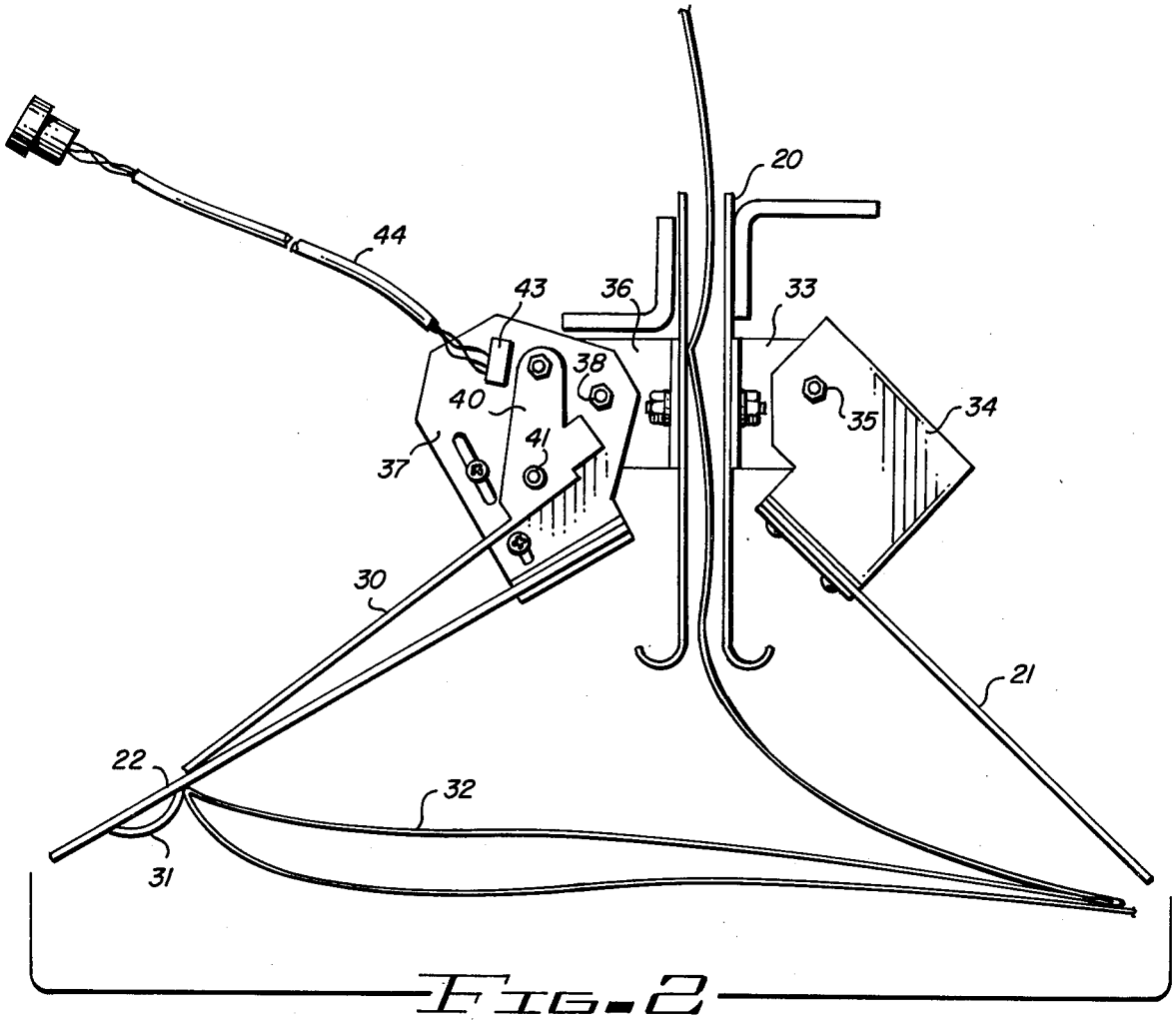
FIG. 2 is a sectional view of the paper feed, paper control strip flapper and the counting switch in accordance with the present invention.
Figure 3:
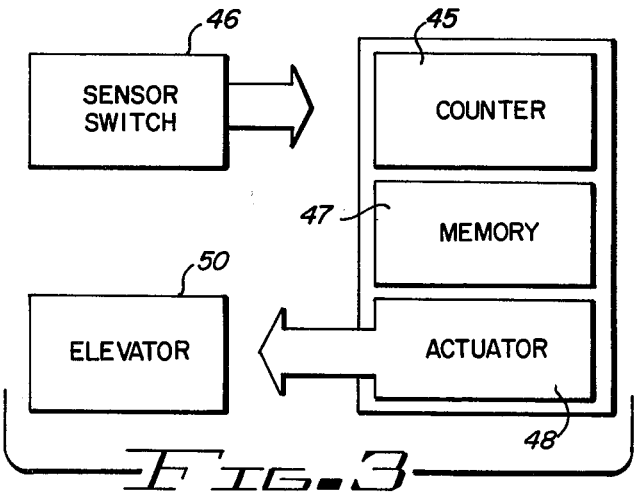
FIG. 3 is a block diagram of the control sequence in the present invention.
Figure 4:
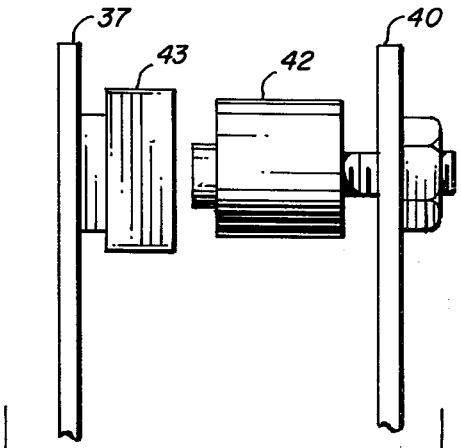
FIG. 4 is a fragmentary elevation of a portion of the switch in accordance with FIG. 2.

FIG. 2 more clearly illustrates the operation of the front forms flapper 21 and auto-stacking sensor 22, having an elongated switch finger 30 against the back of the stacking sensor 22. The stacking sensor 22 has a curved portion 31 which facilitates the movement of the flexible flapper 22 when the paper 32 is folding into the bin 14, which slides along the flapper 22 until it hits the curved protrusion 31, assuring the finger 30 being actuated for each fold of paper falling into the bin. The paper 32 is fed through the paper feed 20 which forms in a pair of elongated slots passing through the elevator for the paper to pass through, and which has a bracket 33 supporting front forms flapper 21 which has a base 34 pivotedly mounted at 35 to the bracket 33. The flexible strip 21 is also adapted to flex as the paper slides thereagainst. On the opposite side of the paper chute 20, a second bracket 36 is attached to the paper chute 20, and has the auto-stacking sensor bracket 37 fixedly attached thereto at 38 which in turn has a paper guide flapper 22 which may be a flexible polymer strip extending from the bracket 37. The switch finger 30 is attached to a pivoting base 40 which pivots on a pivot pin 41 to rotate a magnet 42 (in FIG. 4) each time the finger 30 is moved. The magnet 42 is attached by a nut and acts as a counter-balance to return the finger 30 each time it is moved. Each time the magnet 42 is rotated with bracket 40, a pickup head 43 in a Hall effect switch has a signal generated therein. The pickup head 43 is mounted to the base 37 and is connected through electrical cable 44 to the microprocessor of the high speed printer. Thus, as each folded paper 32 hits the protruding portion 31 of the flapper 22, the sensor 30 is actuated to rotate the base 40 to rotate the magnet 42 (FIG. 4) to generate a signal in the pickup head 43 which is fed to the printer microprocessor. The microprocessor includes a counter 45 which receives a signal from the sensor switch 46 in FIG. 3. The counter 45 counts the number of pulses received, which is stored in a memory 47 located in the microprocessor which then instructs the actuator 48 to send the pulses to the elevator 50. A predetermined number of pulses indicates a predetermined number of paper folds in the stacking bin and the actuating signals are generated to drive the DC motor 23 of FIG. 1, which drives a cog belt to raise the elevator set distances for each so many pulses received. An adjustment is provided for adjusting for different thicknesses of paper.

In actual practice it would, of course, be understood that the programming for the microprocessor to actuate the elevator 16 would include an initialization program so that when the printer is turned on, the elevator, which at this point would not know its position, would be directed to go downward until the processor can no longer see the switch 22 open. The processor then automatically generates signals to the drive motor 23 to raise the elevator a predetermined distance to back the elevator to a predetermined distance from the paper stacked in the bin, or away from the bottom of the bin if there is no paper in the bin at that time. The stacker control logic might also include the stacker full sensor 51 of FIG. 1 to indicate when the stacker reaches its top point, and a transition detect logic for detecting when a correction is in progress and for resetting the page counter and jam counter. The page counter logic counts the pages being stacked in the bin as well as counting stacker jams.

A stacker assembly having an elevator with simple mechanical sensors actuating controls through the microprocessor makes for a reliable accurate stacker assembly for a high speed printer. It should be clear at this point that a printer elevator control mechanism and stacker assembly have been illustrated, but it should be clear that the embodiment shown should be considered illustrative rather than restrictive.

We claim:

1. A printer elevator control in a web refolding mechanism comprising in combination:

an elevator frame movable in response to the operation of a printer toward and away from a stack of refolded paper in a stacking bin;

a printer guide chute for feeding paper into said stack, said paper guide chute being attached to said elevator frame for feeding paper therethrough into said stacking bin;

a pair of paper control flappers each movably mounted to said elevator frame adjacent said paper guide chute for directing paper into alternate folds in the stacking bin;

switch means mounted adjacent one of said paper control flappers and actuated by said paper control flapper being hit by stacking paper for sensing the movement of folds in said web past said guide chute, said switch means generating signals responsive to movement of said one paper control flapper; and means to move said elevator frame responsive to signals from said switch means, whereby a printer elevator can be raised in accordance with the height of stacked paper.

2. A printer elevator control mechanism in accordance with claim 1, in which each of said pair of paper control flappers includes a flat elongated flexible strip of material.

3. A printer elevator control mechanism in accordance with claim 2, in which one of said pair of paper control flappers includes an arcuate portion on one end portion thereof to give a positive movement of said flapper as paper is fed thereby from said paper guide chute.

4. A printer elevator control mechanism in accordance with claim 3, in which said switch means includes a switch having a counter-balanced finger extending therefrom adjacent said one paper control flapper whereby movement of said paper control flapper will move said counter-balanced finger, actuating said switch means.

5. The printer elevator control mechanism of claim 4, in which said counter-balanced finger has a pivoting base having a magnet mounted thereon counter-balancing said finger and generating a signal upon movement of said magnet.

6. The apparatus in accordance with claim 5, in which said means to move said elevator frame responsive to signals includes a counter actuated by said switch means and a memory for storing counted signals to actuate said means to move said elevator frame at intervals.

7. The apparatus in accordance with claim 6, in which said means to move said elevator frame includes means to generate a signal for driving an electric motor in a forward or reverse direction for raising or lowering said elevator frame.

8. The apparatus in accordance with claim 7, in which said paper guide chute is mounted to said elevator frame for paper to pass through said elevator frame and an elongated guide chute.

9. The apparatus in accordance with claim 8, in which said printer elevator control mechanism includes a stacker full sensor for sensing the elevator reaching its top position.

* * * * *